United States Patent [19]

Widmyer

[11] 4,350,203

[45] Sep. 21, 1982

[54] WELL PRODUCTION SYSTEM TO PREVENT CAVE-IN AND SLOUGHING IN UNCONSOLIDATED FORMATIONS

[75] Inventor: Richard H. Widmyer, Houston, Tex.

[73] Assignee: Texaco Inc., White Plains, N.Y.

[21] Appl. No.: 210,874

[22] Filed: Nov. 28, 1980

[51] Int. Cl.[3] ..... E21B 43/04

[52] U.S. Cl. ..... 166/51; 166/278; 166/303

[58] Field of Search ..... 166/278, 51, 57, 222, 166/157, 158, 276, 303; 299/16, 17, 5

[56] References Cited

U.S. PATENT DOCUMENTS

| | | | |
|---|---|---|---|
| 1,530,221 | 3/1925 | Uren | 166/278 |
| 2,154,461 | 4/1939 | Layne | 166/278 |
| 2,205,422 | 6/1940 | Layne | 166/278 |
| 2,349,062 | 5/1944 | Uren | 166/278 |
| 2,597,554 | 5/1952 | West | 166/278 |
| 2,941,594 | 6/1960 | Ladd et al. | 166/276 |
| 3,393,736 | 7/1968 | Goodwin | 166/276 |
| 3,822,750 | 7/1974 | Ping | 166/309 |
| 3,951,457 | 4/1976 | Redford | 166/303 |
| 4,066,127 | 1/1978 | Harnsberger | 166/278 |
| 4,114,691 | 9/1978 | Payton | 166/276 |
| 4,124,074 | 11/1978 | Allen et al. | 166/278 |

*Primary Examiner*—Stephen J. Novosad

*Attorney, Agent, or Firm*—Carl G. Ries; Jack H. Park; Theron H. Nichols

[57] ABSTRACT

A well production system for controlling ingress and egress of high pressure fluid through the annuli formed between the well and a screen support tube internally thereof, and the screen support tube and an internal high pressure wash pipe with valves for maintaining constant high fluid pressure against the overburden during work in the well, as during drilling of an enlarged cavity therein for preventing cave-in and sloughing of the unconsolidated formation well walls until a sand pack is formed and the well producing.

9 Claims, 7 Drawing Figures

P
21
11
V
12
19
15
22
V
P
ANNULUS 14
20
23
17
10
18
24
P
V
V
P
ANNULUS 16
13
29
28
25
27
26
24

WELL PRODUCTION SYSTEM TO PREVENT CAVE-IN AND SLOUGHING IN UNCONSOLIDATED FORMATIONS

BACKGROUND OF THE INVENTION

This invention pertains to a well production system having sand control in unconsolidated, petroliferous formations. Basically, this invention solves the problem of cave-in and sloughing during drilling, enlargement, i.e., underreaming, gravel and screen placement, and/or liner placement.

It is most desirable to utilize a large gravel or sand pack. The larger the sand pack, the more surface is available for sand pack drainage and for filtering for increased production of oil from the well. To form a large gravel pack, increased underreaming of the open hole below the casing for forming a larger cavity is required. Thus in unconsolidated sand formation the result is formation cave-in and sloughing thereof and during the subsequent steps of forming and placing the sand pack and screen and/or liner placement.

For solving this problem, this invention includes the novel feature or apparatus for maintaining the sides of the unconsolidated formation under high positive pressure at all times from the time the high pressure fluid jetting starts forming the cavity in the well until a sand pack is completed for production of the well. This problem is prevalent, for example, from the formerly Texaco Slocum Field (bought in about 1902) in Anderson County, Texas to the Athabasca Tar Sands of Canada.

OBJECTS OF THE INVENTION

Accordingly, a primary object of this invention is to provide a novel combination of elements in a well for preventing caving-in and sloughing of the unconsolidated formation well walls until a sand pack is formed.

A further object of this invention is to provide an apparatus for preventing caving-in and sloughing in a well while working in the well that is easy to operate, is of simple configuration, is economical to build and assemble, and is of greater efficiency.

Other objects and various advantages of the disclosed apparatus for sand formation will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form of the invention wherein like reference numerals designate corresponding parts in the several views in which.

The invention disclosed herein, the scope of which being defined in the appended claims is not limited in its application to the details of construction and arrangement of parts shown and described, since the invention is capable of other embodiments and of being practiced or carried out in various other ways. Also, it is to be understood that the phraseology of terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

THE PREFERRED EMBODIMENT FOR PRACTICING THE INVENTION

The preferred system for placing a well in production that is drilled in an unconsolidated formation where cave-in and sloughing is a common and usual occurrence comprises first a mechanism or system for forming a larger cavity than usual in the well for holding a larger than the conventional sand pack for providing a larger pack drainage area and more sand filtering surface. Normally, this would require considerable underreaming with large unsupported walls resulting in cave-ins and sloughing.

Figure 1:
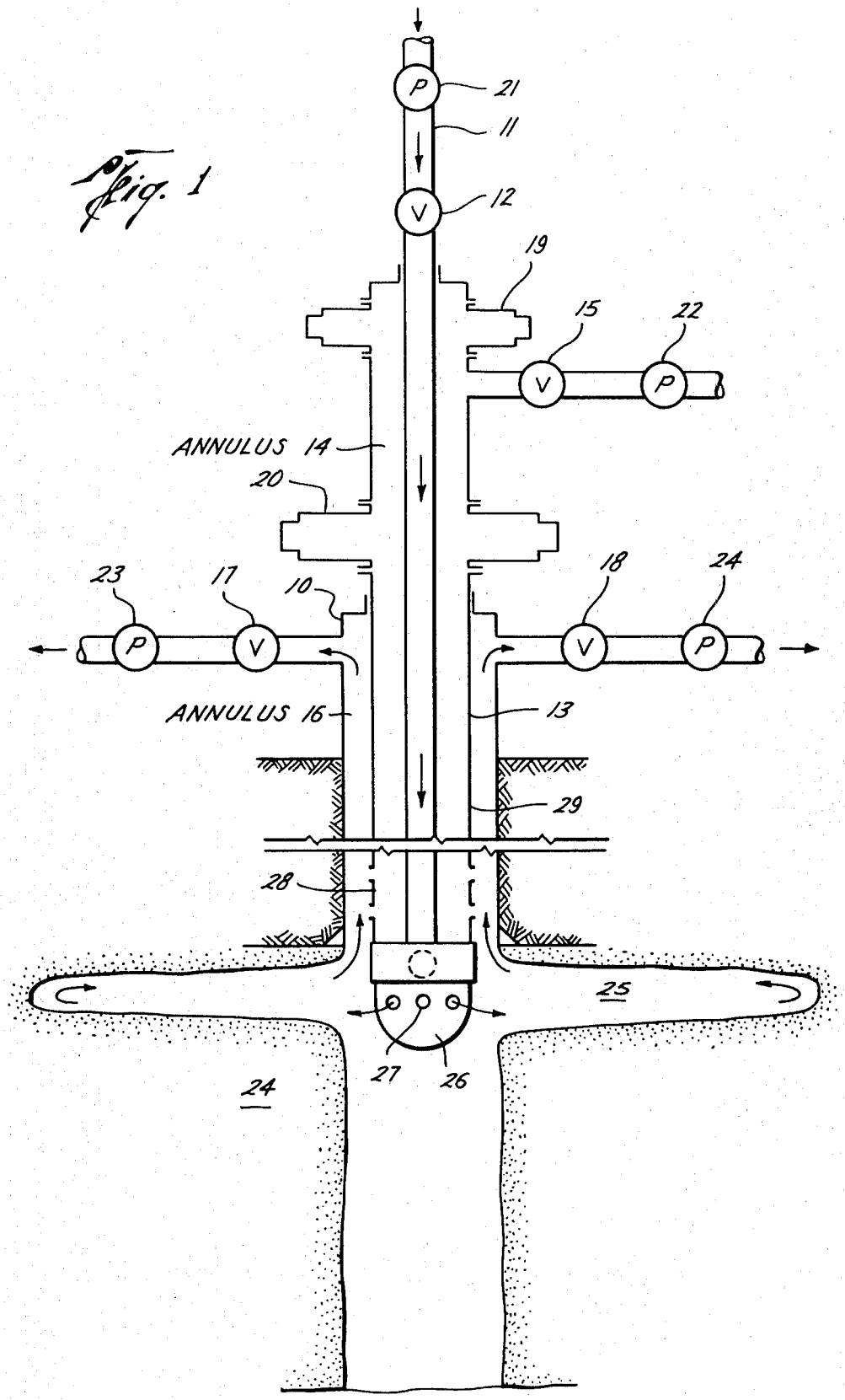
FIG. 1 is a schematic diagrammatic vertical sectional view of the apparatus for sand control of unconsolidated sand formation in which it is just starting to wash out an enlarged cavity for a large sand pack.

FIG. 1 is a schematic diagrammatic vertical sectional view of the apparatus for sand control of an unconsolidated sand formation, and particularly a petroliferous formation. Further, this apparatus may clean out an existing well, whether it is washing out a well that has sanded up, whether it is enlarging a previously drilled well, or whether it is drilling a large cavity in a new well through an unconsolidated petroliferous sand formation mentioned above.

The cased well hole 10, FIG. 1 has a wash pipe 11 with valve 12 centrally supported in the well with structure (not totally shown.) A screen supporting tubing 13 is mounted around the wash pipe and equally spaced therefrom with structure (not shown) forming an inner annulus 14. An outer annulus 16 is formed between the screen tubing 13 and the well casing 10. Outer annulus 16 has two valves, 17 and 18, for example, for controlling fluid therethrough. Likewise, blowout preventer (not shown) may be utilized on the outer annulus 16, if desired. Sources of pumping high pressure fluids in either direction are illustrated schematically as pump 21 on the wash pipe 11, pump 22 on inner annulus 14, and pumps 23 and 24 on outer annulus 16, particularly for maintaining the internal fluid pressure in the well cavity greater than the overburden in the well cavity walls.

First, with the nozzles positioned as shown in FIG. 1, high pressure cold water is ejected into the well immediately below the bottom of the casing into the top of the petroliferous sand formation. The transition is then made with predetermined time intervals to high pressure hot water and then to high pressure steam for ejection from the horizontal nozzles into the surrounding formation for beginning the forming of the large cavity. Then if a nozzle with only one or only a few jet orifices is utilized, the wash pipe and nozzle are rotated and lowered simultaneously slowly for washing out the large cavity 25 with steam ejection.

FIG. 1 shows a typical 16 foot (about 5 meters) diameter cased well hole for example, washed out initially at the very beginning. Then as the wash pipe 11 is lowered slowly for only the depth of the petroliferous strata 24 of the unconsolidated formation to the position of FIG. 2, a large cylindrical shaped cavity 25 is formed for a typical depth of 24 feet (about 7 meters) for example. A nozzle housing 26 having a plurality of orifices 27, FIGS. 1–2, preferably, is attached to the lower end of the screen 28 which in turn is attached to the lower end 29 of a screen support tube 13 on the lower end of the drilling string (not shown).

While a two orifice nozzle requires rotation as it is lowered in the well for washing out a cavity as illustrated in assignee's U.S. Pat. No. 4,066,127, issued Jan. 3, 1978, with several orifices 27, FIG. 1, around the periphery of the nozzle 26, mere lowering of the nozzle slowly is sufficient to wash out the cavity 25, if so desired.

The formation sand returns are carefully monitored for estimating the size of the well cavity as it is formed by washing out the unconsolidated formation.

Figure 2:
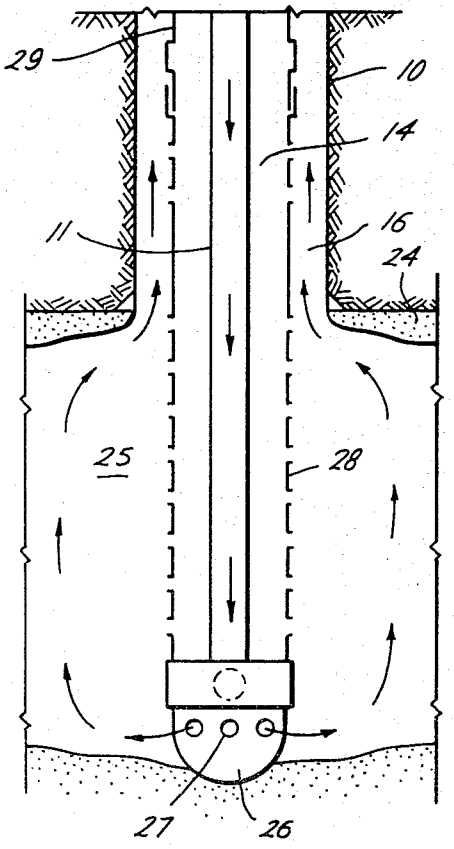
FIG. 2 is a schematic vertical sectional view of the well and apparatus of FIG. 1 after having completed the cavity therein wherein the spent fluid and removed formation material or "pulp" is being ejected from the outer annulus.

FIG. 2 illustrates the well cavity after if has been washed out to the final or total depth (TD). The high pressure fluid pump 21, as a water pump for example, maintains high fluid pressure in the wash pipe 11, and with valve 12 open, maintains high fluid pressure in the well and against the overburden or pressure in the walls of the cavity 25 as they tend to cave-in and slough in. Likewise, high pressure fluid pumps 22, 23, and 24 maintain high pressure in the cavity when their respective valves 15, 17, and 18 are opened as required.

Thus with opening of high pressure valve 12 in the wash pipe, the wash fluid circulation, as water, for example, is circulated down wash pipe 11, FIGS. 1–2 out the nozzle orifice 27, through the cavity 25 picking up any loose material, and ejecting it up the outer annulus 16 through valves 17 and 18 for maintaining a high positive fluid pressure against the walls of the cavity for preventing caving-in and sloughing of the cavity walls, FIG. 2.

REVERSAL OF FLOW STEPS

Figure 3:
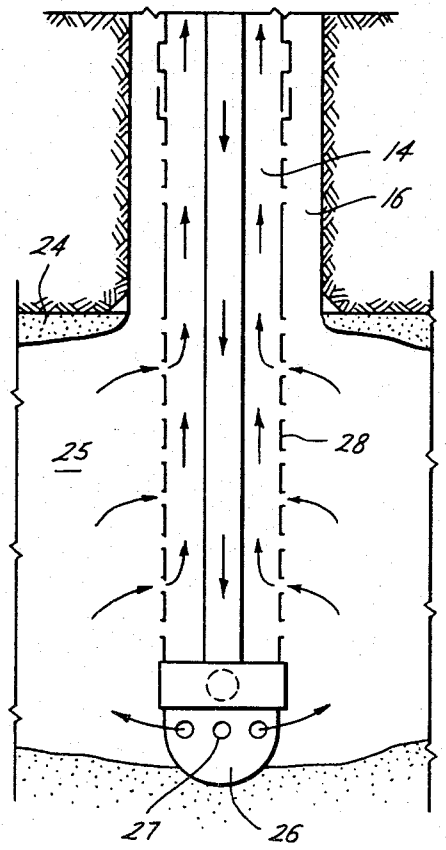
FIG. 3 is a schematic vertical sectional view of the well of FIG. 2 with the fluid flow of spent fluid from the outer annulus having been changed to exit from the inner annulus after the formation material has been removed.

FIG. 3 shows the first step in reversing the fluid flow of FIG. 2 for eventually depositing the gravel pack in the large cavity. The inner annulus valve 15, FIG. 1, is opened while simultaneously, or with a slight delay, outer annulus valves 17 and 18 are closed in making the change over of ejecting the cavity fluids up and out of the inner annulus 14 instead of the outer annulus 16. During this change over of ejected fluids, the valves 15 and 17, 18 are operated gradually and simultaneously in order to maintain the high positive fluid pressure on the walls of the cavity, to prevent caving-in and sloughing of the cavity walls, FIG. 4.

Figure 4:
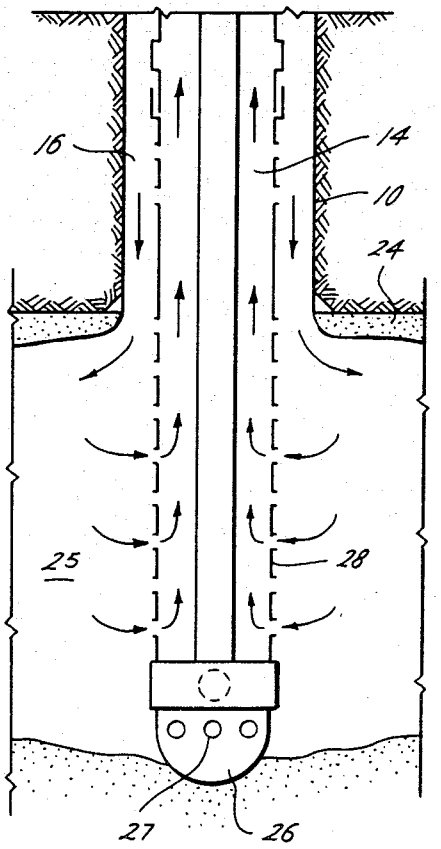
FIG. 4 is a schematic vertical sectional view of the well of FIG. 3 with the fluid flow illustrated as having been changed by ceasing flow in the wash pipe and simultaneously beginning flow down the outer annulus.

FIG. 4 illustrates the resultant fluid flow after the outer annulus valves 17 and 18, FIG. 1, are opened and gradually and simultaneously, or with a slight delay, the wash pipe valve 12 is closed for changing the inlet fluid flow from the wash pipe 11 to the outer annulus 16. During this change over of injected fluids, valves 12 and 17, 18 are operated simultaneously in order to maintain the high positive fluid pressure on the walls of the cavity to prevent caving-in and sloughing of the cavity walls, FIG. 5. Now total reversal of fluid has been accomplished while maintaining the high positive pressure on the cavity walls.

Figure 5:
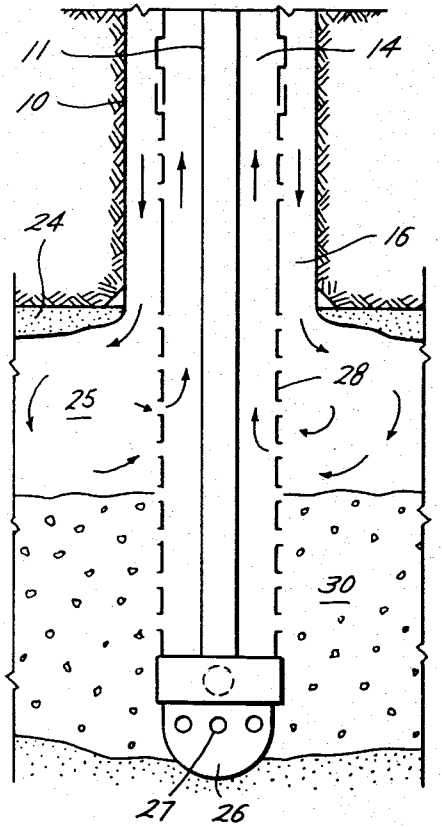
FIG. 5 is a schematic vertical sectional view of the well of FIG. 4 with sand being commingled with the incoming fluid flow for forming a sand pack in the well cavity.

Now, one of the valves 17 or 18, FIG. 5, is operated to commingle sand with the injection fluid as it is ejected down the wash pipe 11 to the cavity 25 while maintaining high fluid pressure against the overburden for preventing cave-in and sloughing of the unconsolidated formation well walls. The sand fills the cavity from bottom up, and is filtered out on the screen as the injection fluid returns up the inner annulus 14 after passing through the screen 28. As the sand pack 30 is formed completely around the screen, the increased fluid pressure in outer annulus 16 will so indicate the filling of the cavity and thus the completion of the sand pack.

Figure 6:
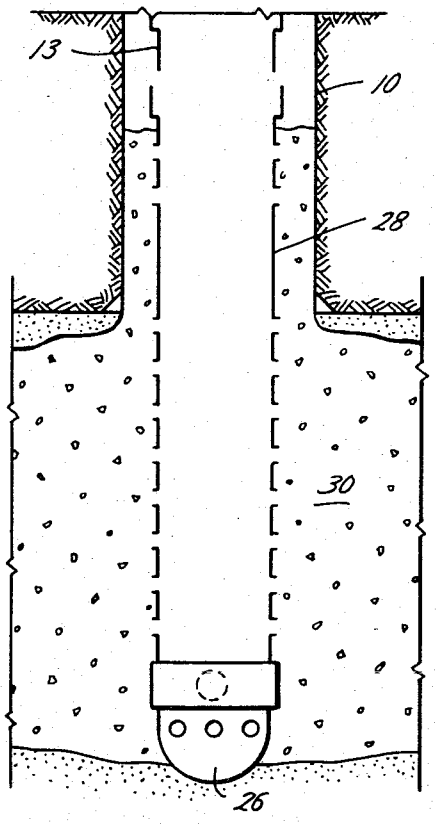
FIG. 6 is a schematic vertical sectional view of the well of FIG. 5 after completion of the gravel pack has been detected and the wash pipe has been removed and the screen support tube is being removed.

As illustrated in FIGS. 1 and 6, the large blowout preventer 20 is then removed and then the wash pipe 11 and screen supporting tubing 13 are removed.

Figure 7:
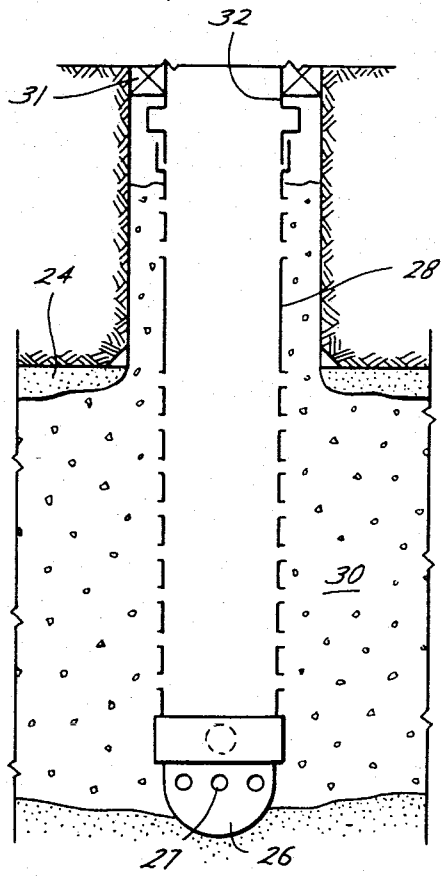
FIG. 7 is a schematic vertical sectional view of the well of FIG. 6 with the production tube not shown and with a packer installed for placing the well in production status.

FIG. 7 illustrates that after the circulation has stopped, then the small blowout preventer 19 is removed, a packer 31 is lowered in position, and a production tube 32 is connected to the top of the screen and packer to place the well in production status for flowing fluids, as crude oil from the petroliferous unconsolidated sand formation flows through the sand pack, through the screen, and up the production tube to the surface, a pump being added if necessary.

Accordingly, it will be seen that the disclosed well production system to prevent cave-in and sloughing in unconsolidated formations will operate in a manner which meets each of the objects set forth hereinbefore.

While only one mechanism has been disclosed, it will be evident that various other modifications are possible in the arrangement and construction of the well production system.

I claim:

1. A well production and sand pack forming system for use in a well in an unconsolidated formation having an overburden, for preventing cave-in and sloughing in the well while working in the well comprising, (a) tubing supported screen means positioned internally in the well for forming an outer annulus between said screen means and the walls of the well, (b) wash pipe means positioned internally in said screen means for forming an inner annulus between said wash pipe means and said screen means, (c) high pressure fluid source means at the surface for injecting into each of said wash pipe means and said outer annulus, and (d) valve means for controlling the ingress and egress of said high pressure fluid therein each of said wash pipe means, inner annulus, and outer annulus for maintaining a constant high fluid pressure against the overburden during work in the well for preventing cave-in and sloughing of the unconsolidated formation well walls until a sand pack is formed therein.

2. In a well production and sand packing forming system for use in a well in an unconsolidated formation having an overburden wherein a tubing supported screen means is positioned internally of the well with a wash pipe means positioned internally of the support tubing and screen with a jet nozzle means at the bottom thereof forming an inner annulus between the wash pipe means and the tubing-screen means and for forming an outer annulus between the tubing-screen means and the well walls, the improved well production system including, (a) high pressure fluid pump means for supplying high pressure fluid to said wash pipe means and each of said annuli, and (b) valve means for each of said wash pipe means, inner annulus, and outer annulus for controlling the ingress and egress of said high pressure fluid therein each for maintaining a constant high fluid pressure against the overburden during work in the well for preventing cave-in and sloughing of the unconsolidated formation well walls until a sand pack if formed therein.

3. A well production and sand pack forming system for use in a well in an unconsolidated formation having an overburden, for preventing cave-in and sloughing in the well while working in the well comprising, (a) tubing supported screen means for being lowered to the bottom of the well for forming an outer annulus means, (b) wash pipe means positioned internally of said screen means, for forming an inner annulus means with the screen means and having a nozzle means for washing out a cavity in the well, (c) high pressure fluid pump means for supplying high pressure fluid to the wash pipe means and said two annuli means, and (d) valve means for each of said wash pipe means, inner annulus means, and outer annulus means for controlling the ingress and egress of said high pressure fluid therein each for maintaining a constant high fluid pressure against the overburden during work in the well for preventing cave-in and sloughing of the unconsolidated formation well until a sand pack is completely formed therein.

4. A system as recited in claim 3 wherein, (a) said high pressure fluid pump means for supplying any one of cold water, hot water, and steam to any one of said wash pipe, inner annulus, and outer annulus when required for maintaining a constant high fluid pressure against the well walls during work therein for preventing cave-in and sloughing of the unconsolidated formation well walls until the sand pack is completely formed.

5. A system as recited in claim 3 wherein, (a) said outer annulus valve means is operable with said wash pipe valve means for controlling the exhaust flow of spent drilling fluid and removed material up and out of said outer annulus for maintaining a constant high fluid pressure against the well walls during high pressure fluid drilling of the cavity in the well for preventing cave-in and sloughing of the unconsolidated formation well walls.

6. A system as recited in claim 3 or 5 wherein, (a) said outer annulus valve means is operable with the gradual opening of said inner annulus valve means for gradual closing of the outer annulus valve means for maintaining the high fluid pressure against the overburden for preventing cave-in and sloughing of the unconsolidated formation well walls until the sand pack is completely formed.

7. A system as recited in claim 3 wherein, (a) said outer annulus valve means is operative with the gradual closing of said wash pipe means for gradual opening of said outer annulus valve means while maintaining high fluid pressure against the overburden for preventing cave-in and sloughing of the unconsolidated formation well walls until the sand pack is completely formed.

8. A system as recited in claim 3 or 7 wherein, (a) said open outer annulus valve means also being responsive to the completely closed wash pipe valve means for commingling and injecting sand with injection fluid down said outer annulus means for filling the cavity with said sand pack while maintaining high fluid pressure against the overburden for preventing cave-in and sloughing of the unconsolidated formation well walls.

9. A well production and sand packing system for producing a well in an unconsolidated formation having an overburden wherein the well has an inner high pressure wash pipe means, an inner annulus formed by a screen around the wash pipe means, and an outer annulus around the screen comprising in combination, (a) control valve means for each of said wash pipe means and inner and outer annuli for controlling the ingress and egress of fluids and removed formation material from therein for forming a sand pack in the well and simultaneously said control valve means comprising means for applying and maintaining a positive fluid pressure against the cavity walls to prevent cave-in and sloughing of the formation cavity walls until the sand pack is formed.

* * * * *